US009863419B2

(12) United States Patent
Charwot et al.

(10) Patent No.: US 9,863,419 B2
(45) Date of Patent: Jan. 9, 2018

(54) GEAR PUMP WITH DRIVE

(71) Applicant: Jihostroj a.s., Velesin (CZ)

(72) Inventors: Radovan Charwot, Velesin (CZ); Vladimir Rynes, Velesin (CZ)

(73) Assignee: JIHOSTROJ A.S., Velesin (CZ)

( * ) Notice: Subject to any disclaimer, the term of this patent is extended or adjusted under 35 U.S.C. 154(b) by 159 days.

(21) Appl. No.: 15/019,061

(22) Filed: Feb. 9, 2016

(65) Prior Publication Data

US 2016/0238004 A1 Aug. 18, 2016

(30) Foreign Application Priority Data

Feb. 13, 2015 (CZ) ..... 2015-97

(51) Int. Cl.

| | |
|---|---|
| ***F04C 11/00*** | (2006.01) |
| ***F04C 2/14*** | (2006.01) |
| ***F04C 15/00*** | (2006.01) |
| ***F04C 2/18*** | (2006.01) |

(52) U.S. Cl.

CPC ..... *F04C 15/0096* (2013.01); *F04C 2/14* (2013.01); *F04C 2/18* (2013.01); *F04C 11/008* (2013.01); *F04C 2240/50* (2013.01)

(58) Field of Classification Search

CPC ..... F04C 11/008; F04C 15/0096; F04C 2/14; F04C 2/18; F04C 2240/50

USPC ..... 418/132, 206.1

See application file for complete search history.

(56) References Cited

U.S. PATENT DOCUMENTS

| | | | | |
|---|---|---|---|---|
| 4,470,776 | A | 9/1984 | Kostek et al. | |
| 5,076,770 | A | 12/1991 | Dabling et al. | |
| 5,252,047 | A | 10/1993 | Joy | |
| 2003/0194342 | A1 | 10/2003 | Bhagavatula | |
| 2006/0024186 | A1* | 2/2006 | Canal | F01C 1/10 418/61.2 |
| 2008/0247882 | A1* | 10/2008 | Earhart | F04C 2/102 417/216 |

FOREIGN PATENT DOCUMENTS

| | | |
|---|---|---|
| GB | 1 133 737 | 11/1968 |

OTHER PUBLICATIONS

Czech Republic Search Report dated Nov. 12, 2015.

* cited by examiner

*Primary Examiner* — Mark Laurenzi
*Assistant Examiner* — Dapinder Singh
(74) *Attorney, Agent, or Firm* — Jacobson Holman, PLLC.

(57) ABSTRACT

The present invention is a gear pump with a drive with at least one integrated cooling circuit which includes a housing mounted with a drive gear and a driven gear, a drive connected with the drive gear by a drive shaft and a means to dissipate the loss flow of the gears to a suction space of the gear pump, in which the loss flow of the working fluid is led into the integrated cooling circuit of the drive and is subsequently discharged into the suction space.

8 Claims, 5 Drawing Sheets

GEAR PUMP WITH DRIVE

FIELD OF THE INVENTION

The invention relates to a mechanically driven gear pump for delivering a precise flow of the working fluid, which works under high pressures, and which is equipped with a drive with an internal cooling circuit.

BACKGROUND OF THE INVENTION

There are known gear pumps for hydraulic systems which are equipped with two gears. The gear cogs interlock, wherein during rotation they carry the working fluid from the suction space into the discharge space, and they are simultaneously in tight contact with each other to prevent the return of the working fluid from the discharge space into the suction space. The gears, together with the sleeves of the pins, are stored in the pump housing, wherein one of the gears is driven and the second gear is driving. The drive gear is connected with a drive via a shaft extending through the housing, which is rigidly attached to the housing of the gear pump by a flange. Waste heat is removed from the drive by an integrated cooling circuit. Gear pumps are widely used in a variety of technical fields, including aviation, where they are used e.g. for refueling aircraft turbine engines, for example of Auxiliary Power Units (APU) which serve to power aircraft electrical systems and starting systems. Such gear pumps have high demands on smooth operation and stability of performance and traffic parameters.

The disadvantages of gear pumps consist in the fact that during pump operation at a high working fluid pressure, a loss flow occurs between the moving and the stationary parts of the pump. It is also necessary to ensure good lubrication of the contact surfaces of the movable and stationary parts, since the gears operate at high rotational speeds. High rotational speeds also cause the release of heat within the housing of the gear pump, which heats up. Overheating the housing leads to volume changes in the material, which may lead to malfunction or instability of the operating parameters. The drive which is connected to the housing of the gear pump also heats up and requires lubrication and cooling in the areas of friction of the moving and stationary parts. Loss flow is formed by the working fluid, which, influenced by high pressure, is pushed between the moving and the stationary parts of the gear pump, for example between the gear pins and their sleeves.

The problem with the loss flow of the working fluid is resolved for example by patent document U.S. Pat. No. 4,470,776 B, which describes a gear pump whose loss flow is guided by at least one means for guiding the loss flow. The means consists of channels around the pins and bearings for their lubrication and reduction of friction, whereupon the loss flow is led back into the suction space of the pump, i.e. to the suction inlet.

The issue of cooling the drive can be resolved by an external cooling circuit which has its own cooling medium and which is equipped with its own pump and which is integrated into the drive system and the gear pump. The disadvantages of the external cooling are that it makes the drive assembly and the gear pump more complicated by design, heavier, bulkier, and more expensive. If the externally cooled gear pump with drive should be used in aviation, the large mass of the assembly is a complication and a considerable disadvantage.

Another patent document GB 1 133 737 B describes an invention in which the loss flow of the pump uses the gears of the pump to cool the shaft. This eliminates the need to externally cool the gear pump, because the working fluid replaces the cooling medium. The disadvantage of this solution is that it does not solve the cooling of the drive unit, so the drive unit must be equipped with external cooling or cooled in another way.

The task of the present invention is to create a gear pump with a drive that would eliminate the aforementioned disadvantages and which would be characterized by a simple and operationally reliable system of cooling the drive, with complete elimination of the need for external cooling circuits or devices. Such a gear pump could be deployed in the area of high pressures, with minimum size and weight, while maintaining reliability and stability of the operating parameters.

SUMMARY OF THE INVENTION

This task is resolved by the creation of a gear pump with a drive according to the present invention.

The gear pump with drive comprises a housing with a suction space on the side of the drive gear and a discharge space on the side of the driven gear. The pins of the gears are mounted in sleeves using bearings. It further comprises a drive which is provided with at least one integrated cooling circuit and is connected to the housing of the flange with an opening for the drive shaft. The drive shaft connects the drive with the drive gear of the gear pump. It also comprises a means for guiding the loss flow of the working liquid of at least one gear to the suction space.

The essence of the invention consists in the fact that the inlet of the integrated cooling circuit of the drive opens into the housing through an inlet opening in the flange and is connected to a means for guiding the loss flow of the working liquid of at least one gear. The outlet of the integrated cooling circuit of the drive opens into the housing through a passage in the flange and is connected to the suction space of the gear pump.

Loss flow is a phenomenon that accompanies all gear pumps. In normal operation it is considered a negative phenomenon which reduces pump efficiency. Diverting the loss flow to the integrated cooling circuit of the drive, instead of guiding it back into the reservoir of the working fluid or into the suction space, however, is positively utilized. The working fluid absorbs heat well, is constantly in motion, and is distributed throughout the machine where it has ample opportunity to release the accumulated heat. The working liquid represents the function of lubricating, the function of heat exchange medium, and the function of work regarding the transmission of forces within a hydraulic machine. Rectifying the loss flow results in a reduction of the leakage of working fluid, in a reduction of the resistance of the environment, and in an improvement in the efficiency of the drive assembly and the gear pump.

In another preferred embodiment of the gear pump with drive according to the present invention, the means for guiding the loss flow of the working liquid from the area of the driven gear includes at least one diverting groove formed in at least one bearing mounted in the sleeve of the pin of the driven gear. The diverting groove is parallel with the pin of the driven gear and is longer than the pin of the driven gear. It further includes at least one plate for channeling the loss flow arranged between the front side of the pin of the driven gear and the flange housing. Part of the means is also a hole passing through the pin of the driven gear connected to the inlet opening for guiding the loss flow to the integrated cooling circuit. The means forms a path of least resistance for the loss flow of the working fluid, and therefore the loss flow is not pushed out of the pump space through anywhere else. Channeling the loss flow through the center of the gear to the inlet opening results in a smooth connection to the integrated cooling circuit, if the gear pump is working, then the flow of the heat exchange medium in the cooling circuit is simultaneously realized.

In another preferred embodiment of the gear pump with drive according to the present invention, the means for guiding the loss flow of the working liquid from the area of the drive gear includes at least one diverting groove formed in at least one bearing mounted in the sleeve of the pin of the drive gear. The diverting groove is parallel with the pin of the drive gear and is longer than the pin of the drive gear. It also includes at least one plate for channeling the loss flow arranged between the front side of the pin of the drive gear and the cover of the housing. The hole passing through the pin of the drive gear connected to the passage is also part of the means. Furthermore, on the flange on the front side of the pin of the drive gear, there is formed an outlet groove interconnecting the passage and the suction space. Loss flow also occurs at the drive gear as well. The loss flow is guided, by the means, to the suction space, where it is added to by working fluid pouring back from the cooling circuit to the pump through the passage for the drive shaft. The outlet groove diverts the loss flow info the suction space.

In a further another preferred embodiment of the gear pump with drive according to the present invention, there are, in the cover of the housing and in the flange against the plates, grooves created for mounting a flexible gasket. The flexible gasket not only seals the pump, but it also creates a predefined pressure, which is transmitted through the plates to the gear sleeves. Simultaneously, the drive shaft passes inside the drive through at least a part of the integrated cooling circuit to lubricate it with the working fluid. If the working fluid flows around the drive shaft, the working fluid adheres to the shaft and thus also serves as a means for lubrication between the movable part and the stationary part.

In a further another preferred embodiment of the gear pump with drive according to the present invention, the drive is formed by an electric motor and control electronics. Electric motors equipped with control electronics are able to work in stable rotation speeds for maintaining a constant pressure at the outlet of the gear pump. Speed fluctuation, especially in the aviation industry, is inadmissible in terms of the safety of machine operation.

In a further another preferred embodiment of the gear pump with drive according to the present invention, the control electronics and the drive body have a separate integrated cooling circuit whose working fluid inlet is located in the discharge space of the working fluid of the pump and the outlet of the working fluid opens to the pump outlet. If the loss flow is insufficient to cool the control electronics, it is possible to equip the control electronics with a separate integrated cooling circuit.

In a further another preferred embodiment of the gear pump with drive according to the present invention, the outlet of the working liquid of the separate integrated cooling circuit is equipped with a three-way solenoid valve. According to the preset mode of operation of the gear pump with drive, the working fluid with separate integrated liquid cooling circuit can be fed back into the suction space or led away from the gear pump with drive. The valve is easy to operate via an electronic control.

The advantages of the gear pump with drive having at least one integrated cooling circuit consist in the use of the loss flow for cooling the drive, and in the arrangement of the construction of the gear pump which is compact, light-weight, and reliable, and also in the redefined pressure of the plates on the sleeves of the pins, and in the facilitation of the flow of the working fluid back into the suction space via the inlet groove.

CLARIFICATION OF THE DRAWINGS

The invention is more closely illustrated in the following drawings, wherein.

It is understood that the hereinafter described and illustrated specific examples of the realization of the invention are presented for illustrative purposes and not as a limitation of the examples of the realization of the invention to the cases shown herein. Experts who are familiar with the state of technology shall find, or using routine experimentation will be able to determine, a greater or lesser number of equivalents to the specific realizations of the invention which are specifically described here. These equivalents shall also be included into the scope of the patent claims.

Figure 1:
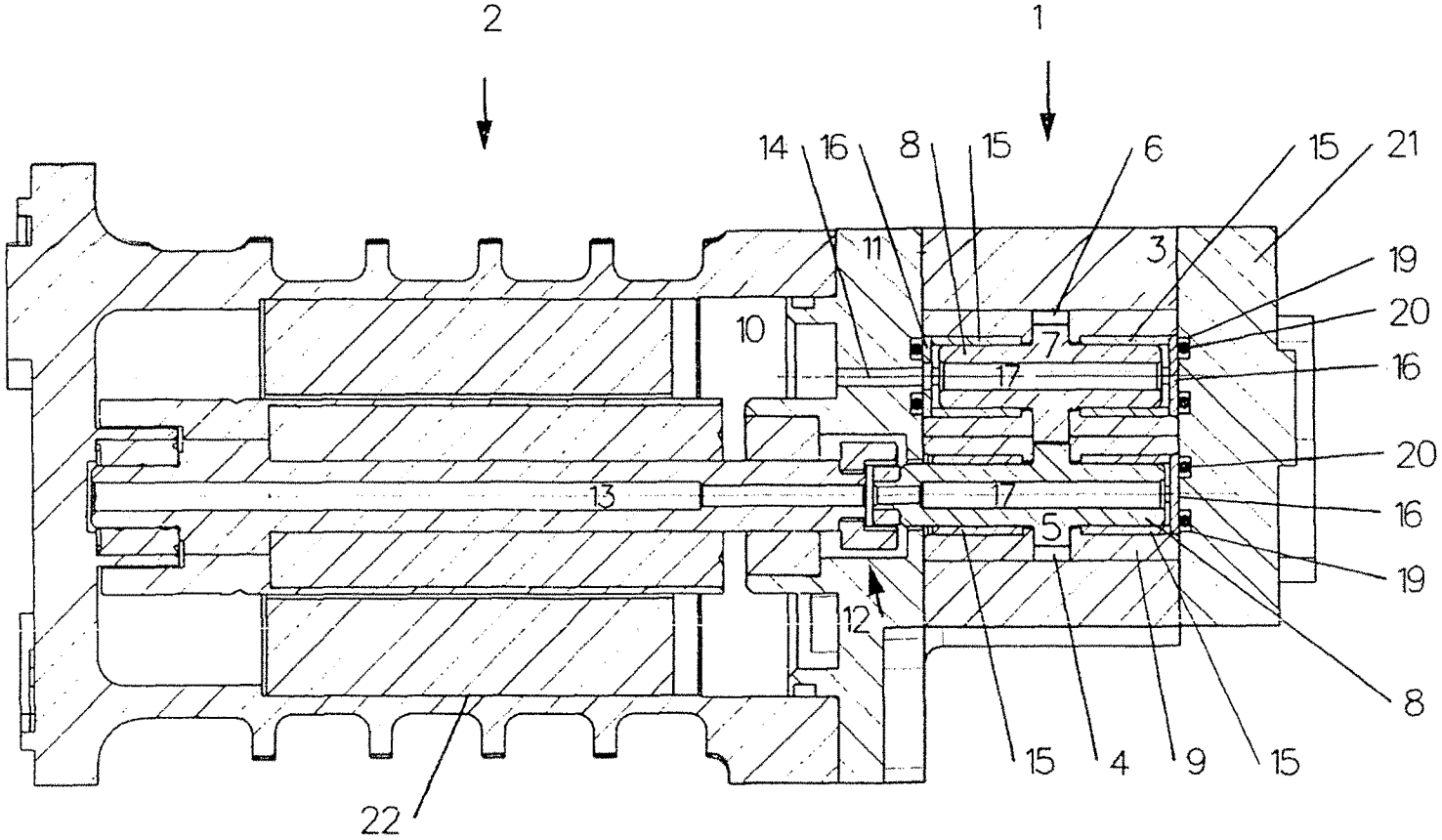
FIG. 1 depicts a sectional view of the gear pump with drive.

FIG. 1 shows the gear pump 1 which is connected to the drive 2. The drive 2 is an electric motor 22 and is equipped with an integrated cooling circuit 10, which is integrated in the body of the drive 2. The gear pump 1 transports the working fluid under high pressure. The working liquid is e.g. hydraulic oil or fuel. The gear pump 1 is formed by a rigid housing 3, which is on equipped on one side with a flange 11 and on the opposite side with a removable wall forming the cover 21. In the space of the housing 3 there are two gears 5 and 7, which divide the space of the housing 3 into two parts. The suction space 4, in which the suction of the working fluid occurs, faces the drive gear 5, while the space 6 of the discharge of the working liquid faces the driven gear 7. The drive gear 5 is, through the opening 14 in the flange 11, connected to the drive shaft 13 of the drive 2.

Figure 2:
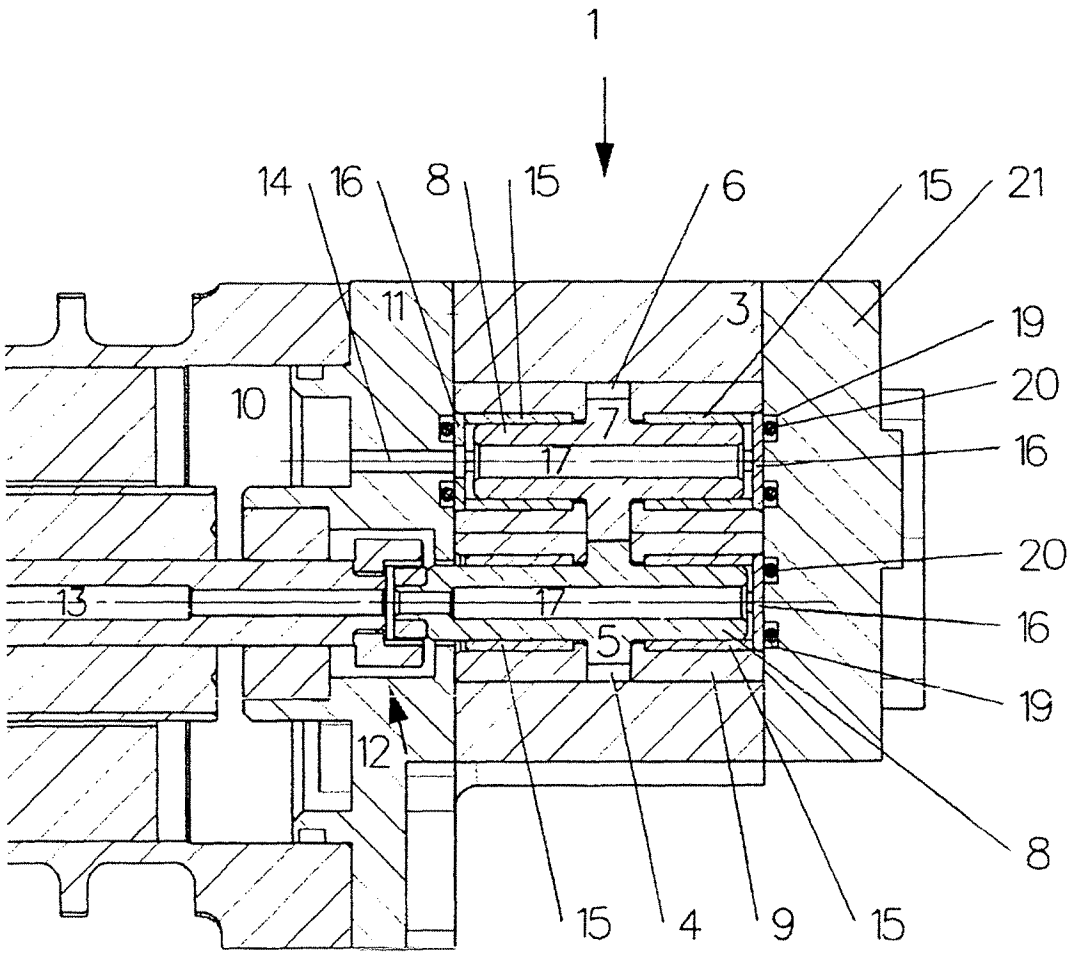
FIG. 2 depicts a more detailed cross sectional view of the gear pump.
Figure 3:
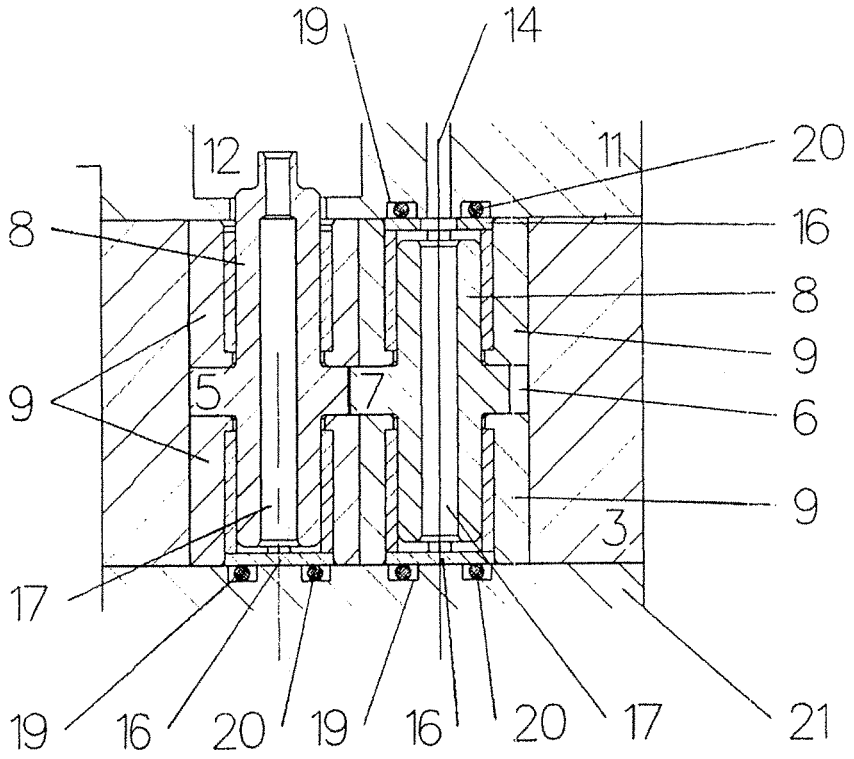
FIG. 3 depicts a top sectional view of the gear pump.

FIGS. 2 and 3 show a more detailed illustration of the gear pump 1. The gears 5 and 7 have an elongated pin 8, which is mounted in the sleeves 9. In the sleeves 9 there is formed a semicircular diverting groove of the bearing 15, which forms part of the means for removing the loss flow. The bodies of the gears 5 and 7 are hollow, so a 17 passes through them. So that the loss flow is channeled, there are placed, at the end faces of the driven gear 7, placed channeling plates 16. The loss flow flows through the diverting groove in the slippery bearing 15 between the sleeve 9 and the driven gear 7 to the channeling plate 16, whereupon the channeling plate 16 diverts the loss flow into the hole 17 located inside the driven gear 7. The loss flow flows through the driven gear 7 through the inlet opening 14 in the flange 11 to the integrated cooling circuit 10 of the drive 2.

The drive gear 5 is also hollow, because also here there occurs loss flow which must be diverted. In the case of the drive gear 5, however, the loss flow is led back into the suction space 4. From the cooling circuit 10, the working fluid returns back through the passage 12 for the shaft 13 in the flange 11 of the outlet groove 18 to the suction space 4.

In the flange 11 and in the cover 21 there are created, opposite the channeling plates 16, grooves 19 for the seal 20, which are provided with elastic sealing 20. The channeling plates 16 abut, on one side, the flexible seal 20 or a spring, and on the other side, the sleeve 9, thus defining the pressure of the sleeves 9 to the gears 5 and 7.

Figure 4:
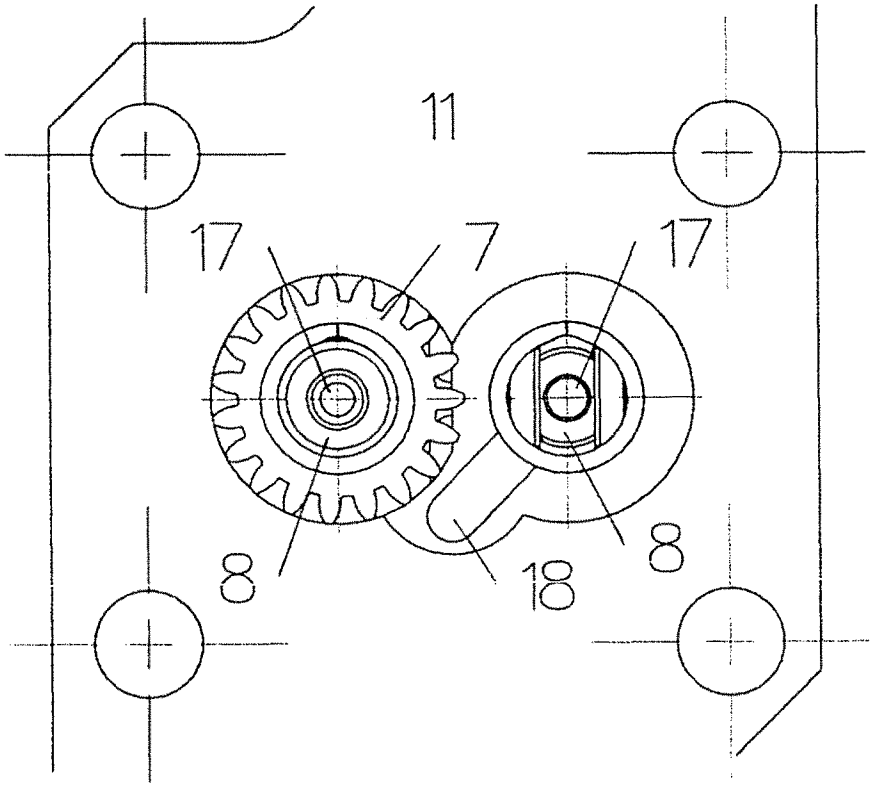
FIG. 4 depicts a side sectional of the gear pump, where the drive gear has been removed to illustrate the outlet grooves.

FIG. 4 shows the flange 11 viewed from the interior space of the housing 3 of the pump 1. From the passage 12 for the shaft 13 there is created, in the flange 11, an outlet groove 18 through which working fluid flows from the cooling circuit 10 of the drive 2 to the suction space 4.

Figure 5:
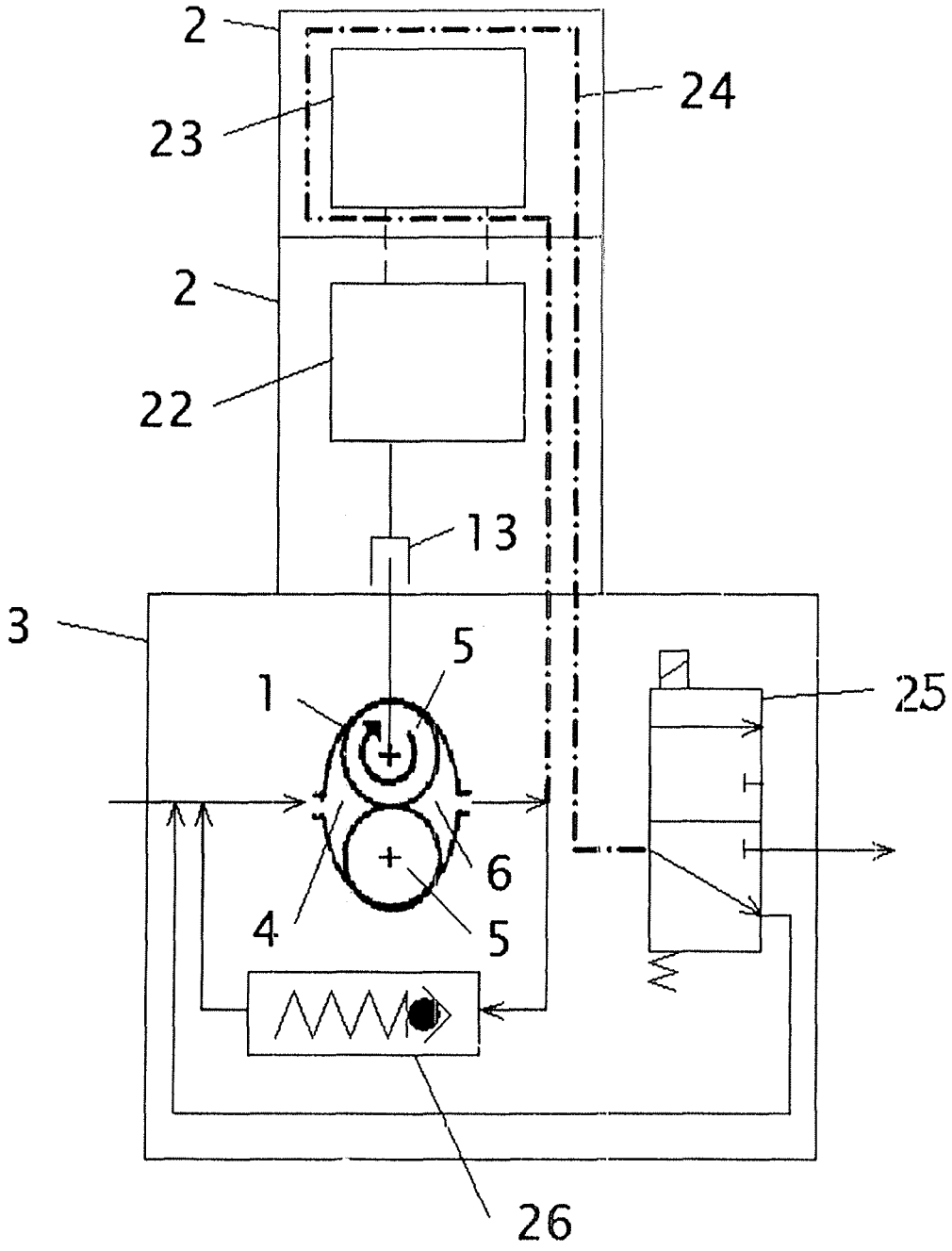
FIG. 5 depicts a diagram of the use of a separate integrated cooling circuit for the control electronics of the drive.

FIG. 5 schematically depicts another possible embodiment of the creation of the gear pump 1 with drive 2. The drive 2 is formed by an electric motor 22 and its control electronics 23. Because the control electronics 23 releases heat during its own work, it needs to be cooled. Cooling is provided by its own integrated cooling circuit 24, which has an inlet for working fluid arranged in the discharge space 6. The working fluid flows into its own cooling circuit 24 and flows out of it into a three-way electromagnetic valve 25. The three-way electromagnetic valve 25, based on its setting, determines where the working fluid will be discharged to, whether it will be led back to the suction space 4, or outside the gear pump 1. The maximum pressure of the working fluid in the gear pump 1 with drive 2 is guarded by a valve 26 which, in an emergency, releases the pressurized working fluid back into the suction space 4.

In an embodiment (not illustrated) of the gear pump 1 with drive 2, the single integrated cooling circuit 10 is incorporated simultaneously in the electric motor 22 and in the control electronics 23. The loss flow of the working fluid is sufficient for cooling the heat released in the electric motor 22 and in the control electronics 23, whereupon it is returned, with the absorbed heat, back to the suction space 4 of the gear pump 1.

INDUSTRIAL APPLICABILITY

The gear pump with drive, according to the present invention, shall find application in a variety of technological fields, including aviation, where such gear pumps are used for e.g. pumping fuel.

OVERVIEW OF THE POSITIONS USED IN THE DRAWINGS

1 gear pump
2 gear pump drive
3 gear pump housing
4 suction space
5 drive gear
6 discharge space
7 driven gear
8 gear pin
9 sleeve
10 integrated cooling circuit
11 flange
12 passage
13 drive shaft
14 inlet
15 bearing
18 plate
17 hole
18 discharge groove
19 groove for seal
20 flexible seal
21 cover
22 electric motor
23 control electronics
24 integrated cooling circuit of the control electronics
25 three-way electromagnetic valve
26 maximum pressure valve

The invention claimed is:

1. A gear pump with drive, comprising: a housing with a suction space on a side of a drive gear and with a discharge space on a side of a driven gear closed on one side by a cover, wherein pins of the gears are mounted via bearings in sleeves, and the drive having at least one integrated cooling circuit and connected to the housing by a flange with a passage for a drive shaft connecting the drive with the drive gear, and a means for guiding a loss flow of a working fluid of at least one gear wheel into the suction space, wherein an inlet of the integrated cooling circuit of the drive opens into the housing through an inlet opening in the flange, is connected with a means for leading the loss flow of the working fluid to at least one gear, and an outlet of the integrated cooling circuit of the drive opens into the housing via a passage in the flange and is connected to the suction space of the gear pump.

2. The gear pump drive according to claim 1, wherein the means for guiding the loss flow of the working liquid from an area of the driven gear includes at least one diverting groove formed in a bearing and mounted in at least one sleeve of the pin of the driven gear, the diverting groove in the bearing is parallel with the pin of the driven gear and is longer than the pin of the driven gear, and at least one plate for channeling the loss flow arranged between the front side of the pin of the driven gear and the flange of the housing, and a hole passing through the pin of the driven gear connected to the inlet opening for guiding the loss flow to the integrated cooling circuit.

3. The gear pump with drive according to claim 1, wherein the means for guiding the loss flow of the working liquid from an area of the drive gear includes at least one diverting groove formed in a bearing mounted in at least one sleeve of the pin of the drive gear, and the diverting groove in the bearing is parallel with the pin of the drive gear and is longer than the pin of the drive gear, at least one plate for channeling the loss flow is arranged between the front side of the pin of the drive gear and the cover of the housing, a hole passing through the pin of the drive gear connecting with the passage, wherein on the flange at the front side of the pin of the drive gear there is formed an outlet groove connecting the passage and the suction space.

4. The gear pump with drive according to claim 2, wherein the cover and in the flange there are created, opposite the plates, grooves for holding flexible seal.

5. The gear pump with drive according to claim 1, wherein the drive shaft passes inside the housing through at least part of the integrated cooling circuit for its lubrication by the working fluid.

6. The gear pump with drive according to claim 1, wherein the drive is formed by an electric motor and by control electronics.

7. The gear pump with drive according to claim 6, wherein the control electronics has its own integrated cooling circuit whose inlet for the working fluid is located in the discharge space of the working fluid of the gear pump, and the outlet of the working fluid opens into the suction space, or opens to outside the gear pump.

8. The gear pump with drive according to claim 7, wherein the outlet of the working fluid from its own integrated cooling circuit is provided with a three-way electromagnetic valve.

* * * * *